US010252892B2

(12) United States Patent
de Kluijver et al.

(10) Patent No.: US 10,252,892 B2
(45) Date of Patent: Apr. 9, 2019

(54) FOUR CABLE OPERATED SCISSORS

(71) Applicant: Nemag B.V., Zierikzee (NL)

(72) Inventors: Willem Albert de Kluijver, Zierikzee (NL); Michel Corbeau, Zierikzee (NL)

(73) Assignee: NEMAG B.V., Zierikzee (NL)

( * ) Notice: Subject to any disclaimer, the term of this patent is extended or adjusted under 35 U.S.C. 154(b) by 0 days.

(21) Appl. No.: 15/568,289

(22) PCT Filed: May 2, 2016

(86) PCT No.: PCT/NL2016/050314

§ 371 (c)(1),
(2) Date: Oct. 20, 2017

(87) PCT Pub. No.: WO2016/178568

PCT Pub. Date: Nov. 10, 2016

(65) Prior Publication Data

US 2018/0134525 A1 May 17, 2018

(30) Foreign Application Priority Data

May 1, 2015 (NL) ..... 2014756

(51) Int. Cl.

| | |
|---|---|
| ***B66C 3/02*** | (2006.01) |
| ***B66C 3/12*** | (2006.01) |
| *E02F 3/47* | (2006.01) |

(52) U.S. Cl.

CPC ..... *B66C 3/12* (2013.01); *B66C 3/02* (2013.01); *E02F 3/47* (2013.01)

(58) Field of Classification Search

CPC .... B66C 3/02; B66C 3/06; B66C 3/12; B66C 3/14; E02F 3/413; E02F 3/4135; E02F 3/47

See application file for complete search history.

(56) References Cited

U.S. PATENT DOCUMENTS

| | | | |
|---|---|---|---|
| 485,193 | A | 11/1892 | Hatch |
| 528,375 | A | 10/1894 | Meier |

(Continued)

FOREIGN PATENT DOCUMENTS

| | | | |
|---|---|---|---|
| CN | 2649555 | Y | 10/2004 |
| CN | 102070076 | A | 5/2011 |
| FR | 2536058 | A1 | 5/1984 |

OTHER PUBLICATIONS

International Search Report from PCT/NL2016/050314 dated Jul. 29, 2016.

Office Action from CN App No. 201680025118.7 dated Nov. 2, 2018.

*Primary Examiner* — Stephen A Vu

(74) *Attorney, Agent, or Firm* — Adsero IP

(57) ABSTRACT

A four cable operated scissors grab, comprising a pair of scissor levers that are connected via a pivot joint to pivot about a pivoting axis, which scissor levers each include a grab shell and a hoist cable connection situated on a first side of the lever with respect to the pivot joint, and a closing cable connection situated on a second side of the lever that is opposite with respect to the pivot joint, so that in use a dedicated hoisting cable is fastened to each lever on the first side of the lever, and a dedicated closing cable is fastened to each lever at the second side of the lever. The scissor levers each include a sheave on the second side of the lever, and said sheaves are each arranged as a first and final closing sheave, so that in use each of the two closing cables extend in a single pass from a closing cable connection on the second side of one lever via the closing sheave on the second side of the other lever to depart from the grab and continue upward to a crane carrying the grab.

22 Claims, 15 Drawing Sheets

(56) References Cited

U.S. PATENT DOCUMENTS

| | | | | | |
|---|---|---|---|---|---|
| 813,528 | A | | 2/1906 | Slocum | |
| 1,545,591 | A | * | 7/1925 | Madine | H01J 5/24<br>174/50.61 |
| 1,571,838 | A | * | 2/1926 | Hutson | B66C 3/12<br>37/184 |
| 1,909,867 | A | * | 5/1933 | Olson | B66C 3/12<br>37/185 |
| 2,617,211 | A | * | 11/1952 | Olson | B66C 3/12<br>37/185 |
| 3,975,044 | A | * | 8/1976 | Briggs | B66C 3/125<br>294/68.23 |
| 4,143,901 | A | * | 3/1979 | van Huuksloot | B66C 3/02<br>294/68.23 |

* cited by examiner

FOUR CABLE OPERATED SCISSORS

RELATED APPLICATIONS

This application is a 35 U.S.C. § 371 national phase application of PCT/NL2016/050314 (WO 2016/178568), filed on May 2, 2016, entitled "Four Cable Operated Scissors Grab", which application claims priority to Netherlands Application No. 2014756, filed May 1, 2015, which is incorporated herein by reference in its entirety.

TECHNICAL FIELD

Background

The invention relates to a four cable operated scissors grab. Such scissors grabs are well known in the art and are commonly used for handling of bulk materials, such as coal or iron ore. A commercially successful four cable operated scissors grab is disclosed in U.S. Pat. No. 4,538,848 and comprises a pair of scissor levers that are connected via a pivot joint to pivot about a pivoting axis, which scissor levers each include a grab shell and a hoist cable connection situated on a first side of the lever with respect to the pivot joint, and a closing cable connection situated on a second side of the lever that is opposite with respect to the pivot joint, so that in use a dedicated hoisting cable is fastened to each lever on the first side of the lever, and a dedicated closing cable is fastened to each lever at the second side of the lever. One or both scissor levers may include a closing sheave on the second side of the lever.

Compared to other types of grabs, for example clamshell grabs that include a triangular frame with pivoting supporting arms, scissor grabs have a number of operational characteristics that are particularly favorable for bulk handling. For example, the scissored configuration allows a relatively low center of gravity, a broad spread of the grab shells, a horizontal closing path of the bottom edges of the shells, flexible chain connections that prevent damage to cargo holds, and a relatively low number of pivot connections that require maintenance. However, the construction of the scissors grab is relatively expensive compared to a clamshell grab.

The present invention aims to improve a scissors grab, in particular with respect to the efficiency of the grab construction and/or its operational characteristics.

SUMMARY

Thereto the invention provides for a four cable operated scissors grab, comprising a pair of scissor levers that are connected via a pivot joint to pivot about a pivoting axis, which scissor levers each include a grab shell and a hoist cable connection situated on a first side of the lever with respect to the pivot joint, and a closing cable connection situated on a second side of the lever that is opposite with respect to the pivot joint, so that in use a dedicated hoisting cable is fastened to each lever on the first side of the lever, and a dedicated closing cable is fastened to each lever at the second side of the lever, wherein the scissor levers each include a sheave on the second side of the lever, wherein said sheaves are each arranged as a first and final closing sheave for the closing cable. In use each of the two closing cables may extend in a single pass from a closing cable connection on the second side of one lever via the closing sheave on the second side of the other lever, and may then depart from the grab and continue upward to a crane carrying the grab.

By arranging each sheave as a first and final closing sheave as claimed, the construction of the grab can be significantly simplified. In particular, each scissor lever needs to include only one closing sheave, and may be free of further closing sheaves that guide the closing cable. This increases the efficiency of the grab and improves operational characteristics as apart from any rotational cable connections, the grab needs to only include maintenance at rotational connections at the final closing sheaves and at the pivot joint. As the two closing cables extend in a single pass from the closing cable connection via the closing sheaves to depart from the grab, the stroke of the closing cables needed to adjust the grab between a closed position and a fully opened position may be significantly shortened. This improves operational characteristics, as the grab may be used more efficiently due to reduced opening and closing times.

It should be noted that as used in the context of this patent specification, a closing sheave is meant to be a sheave which, in operation, is continuously in contact with the closing cable, as opposed to e.g. a push-up sheave or guide which is only during part of an opening and closing cycle in contact with the closing cable. Further, a closing sheave as used in the context of this patent specification is meant to be a sheave which guides the closing cable about at least 60 degrees, preferably at least 85 or 90 degrees its circumference. Further, a closing sheave as used in the context of this patent specification is preferably meant to be a sheave which is rotatably connected to the lever.

It should further be noted that as used in the context of this patent specification, a cable is meant to be a flexible, tension loadable connection element such as a wire, cable or chain, in particular made of steel.

By situating each final closing sheave at or near an end of the second side of the lever that faces away from the pivot joint, the closing momentum can be maximized.

By having the first and second sides of the lever extend continuously at the pivot joint, the construction of the levers can be relatively simple. The scissor levers may include plates, for example steel plates, that extend from the grab shell to the final closing sheave as continuous sections.

By constructing each scissor lever to include two lever plates that extend in interspaced relation, a relatively stiff, strong and light weight lever may be obtained. By arranging the scissor levers to include stiffening profiles on the first sides that extend parallel to the pivoting axis, the construction may be stiff, yet of relatively low weight. The profiles may be embodied as pipes, tubes or beams having open or closed cross section.

The stiffening profiles may be arranged to form a cross stiffener that continues from one side of the shell to another. This significantly adds to providing an efficient, light weight yet stiff construction. The profiles may e.g. extend between the lever plates and between the lever plates and the sides of the grab shells.

By embodying the scissor levers of the pair to be substantially identical, and by connecting them via the pivot joint in a mirrored arrangement, constructional efficiency may be increased further as the number of different parts is reduced.

By situating the closing cable connection at or near an end of the second lever that faces away from the pivot joint, closing momentum may be maximized. Advantageously, the closing cable connection may be located at or near a final closing sheave.

The final closing sheaves may each be provided with a cable guide that covers part of the circumference of the final closing sheave to hold the closing cable on the final closing sheave, e.g. when the closing cable is slack. In particular, the cable guide may guide the closing cable along the circumference to a point of departure from the final closing sheave and from the grab.

By disposing the cable guide movably relative to the final closing sheave, it may be achieved that the cable guide covers the relevant part of the circumference of the final closing sheave independent of the position or orientation of the grab. The cable guide is preferably rotatably disposed relative to the final closing sheave.

The cable guide may include the closing cable connection so as to allow movement relative to the final closing sheave. This way, the end of the closing cable may be used to move, in particular rotate, the cable guide to a part of the circumference of the final closing sheave that needs to be covered to keep the closing cable on the circumference. Preferably, the closing cable connection is rotatably disposed relatively to the lever to prevent wear. Advantageously, the closing cable connection and the cable guide may be integrated to form a closing cable connector with integral cable guide. Such a cable connector with integral cable guide may comprise a carrier, which in use may be rotatably connected to a grab, in particular to a second part of the lever. The carrier may include a first portion to which the cable connects that extends from a rotational joint in a first direction, and may further include a second portion that is provided with a cable guide that extends from the rotational joint in a second, opposite direction, and that covers part of the circumference of a sheave of the grab to hold the cable on the circumference of the sheave. Such a cable connector may be used with any type of grab, and is not limited to use with the grab as claimed, but may also be used in other types of scissor grabs or even other types of grabs.

Advantageously, the rotational joint of the carrier may be carried on the pivot axle of the final closing sheave. This further simplifies construction. The final closing sheave and the carrier may be arranged to be independently rotatable relative to the lever.

The scissor levers may be arranged to pivot about the pivot axis between a closed position of the grab in which side and bottom edges of the shells are adjacent each other and the shells cooperate to form a bucket to hold material to be handled, and a fully opened position of the grab in which the side and bottom edges are spaced apart and define a maximum opening there between through which material to handled can pass.

The grab may be arranged such that, when the grab moves from the closed position to the fully opened position, a plane through the pivot axis and the side and bottom edges of the grab shall has an angular displacement about the pivot axis that is included in the range 50-70 degrees. In more simplified wording, the grab shells may each have a maximum opening angle $\alpha$ that lies between 50 and 70 degrees. In particular, the maximum opening angle $\alpha$ of each shell is at least 55 degrees. Surprisingly, it has been found that such limited angular displacement or limited maximum opening angle $\alpha$ need not significantly influence the operational efficiency of the grab, while it e.g. facilitates the construction of a light weight, stiff and efficient grab because it allows for the provision of stiffening profiles as discussed above.

The grab structure as claimed may include a set of two hoisting cables that are connected to the hoisting cable connections. The grab structure as claimed may alternatively or in addition include a set of two closing cables that are connected to the closing cable connections.

The closing cables may be interconnected via a connecting piece. Such connecting piece may be stiff, such as a yoke, or flexible, such as a chain or rope. Such connecting piece may be affixed to the closing cables near the grab to move along with the cables on the opening and closing stroke of the grab. Such connecting piece may in combination with the arrangement of the sheaves as first and final closing sheaves be useful to enhance the closing force. In addition it may assists to provide a correct fleet angle of the closing cable with respect of the sheaves of the crane carrying the grab. Such a connecting piece may also advantageously be provided on the hoisting cables near the grab.

The invention further relates to a four cable operated scissors grab, comprising a pair of scissor levers that are pivotably connected via a pivot joint, which scissor levers each include a grab shell and a hoist cable connection situated on a first side of the lever with respect to the pivot joint, and a closing cable connection situated on a second side of the lever that is opposite with respect to the pivot joint, so that in use a dedicated hoisting cable is fastened to each lever on the first side of the lever, and a dedicated closing cable is fastened to each lever at the second side of the lever, in which the scissor the levers are arranged to pivot about the pivot axis between a closed position of the grab in which side and bottom edges of the shells are adjacent each other and the shells cooperate to form a bucket that can hold material to be handled, and a fully opened position of the grab in which the side and bottom edges are spaced apart and define a maximum opening there between through which material to be handled can pass, wherein when the grab moves from the closed position to the fully opened open position, a plane through the pivot axis and the side and bottom edges of each grab shell has an angular displacement about the pivot axis that is included in the range of 50-70 degrees, and in particular is at least 55 degrees, and in particular is no more than 65 degrees. In more simplified wording, the grab shells may each have a maximum opening angle $\alpha$ that lies between 50 and 70 degrees. In particular, the maximum opening angle $\alpha$ of each shell is at least 55 degrees. Surprisingly, it has been found that such limited angular displacement or limited maximum opening angle $\alpha$ need not significantly influence the operational efficiency of the grab, while it e.g. facilitates the construction of a light weight, stiff and efficient grab because it allows for the provision of stiffening profiles as discussed above.

It should be noted that the technical features described above may each on its own be embodied in a grab, in particular a scissors grab, i.e. isolated from the context in which it is described, separate from other features or in combination with only a number of features described in the context in which it is disclosed. Each of these features may further be combined with any other feature disclosed, in any combination.

BRIEF DESCRIPTION OF THE DRAWINGS

The invention will be further elucidated on the basis of non-limitative exemplary embodiments represented in the drawings. In the drawings.

It should be noted that the figures are merely schematic representations of preferred embodiments of the invention. In the figures, identical or corresponding parts are represented with the same reference numerals.

DETAILED DESCRIPTION OF THE DRAWINGS

Figure 1:
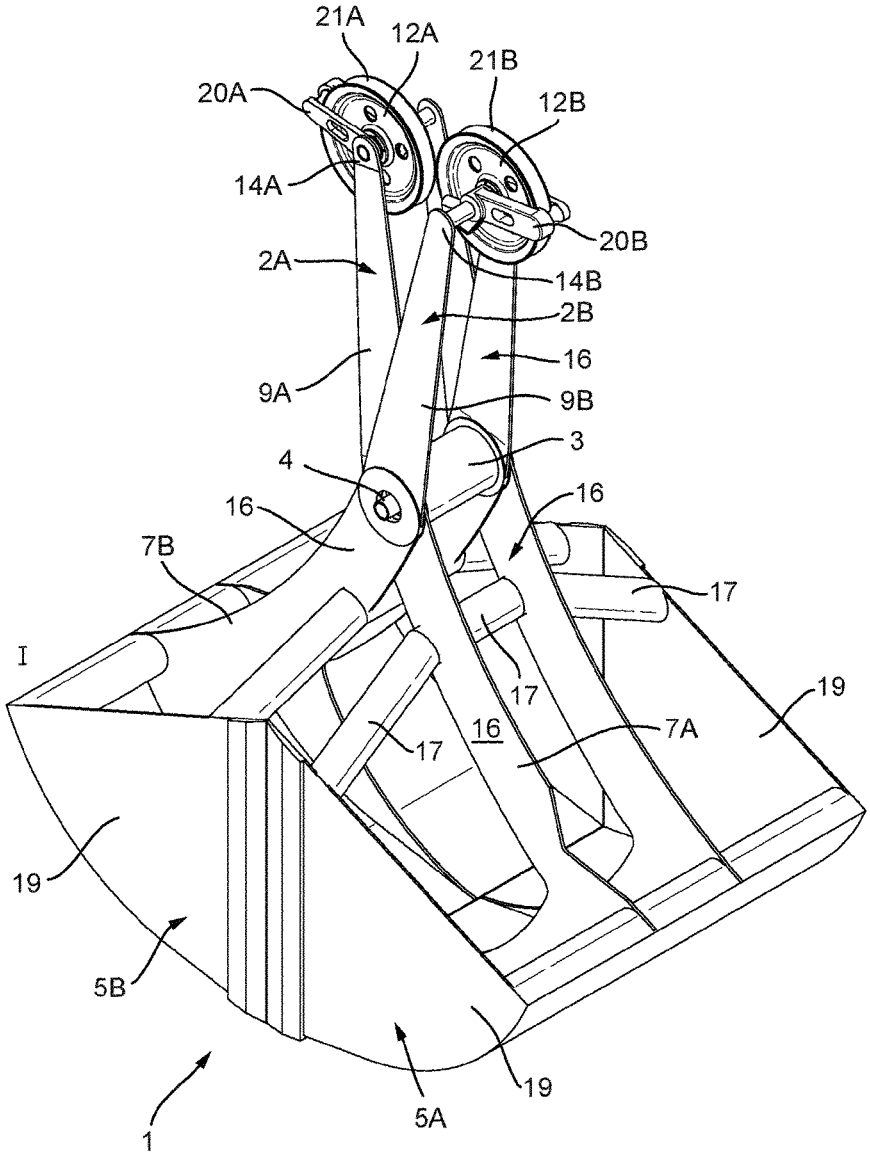
FIG. 1 shows a schematic perspective view of a first embodiment of a grab in accordance with the invention in a closed position.
Figure 2A:
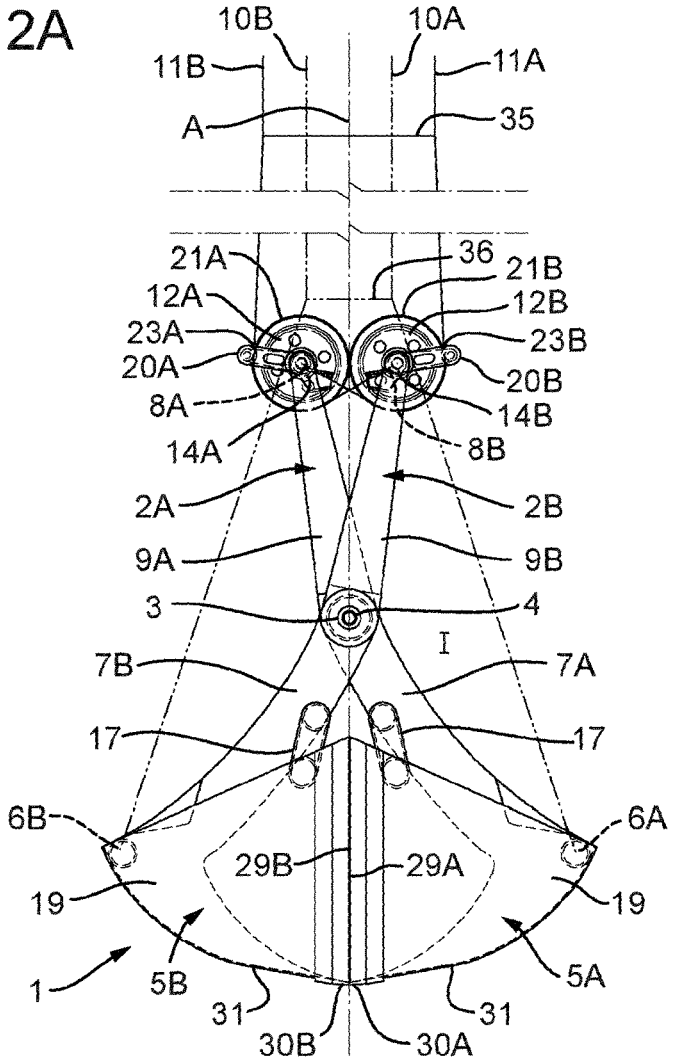
FIG. 2A shows a schematic front view of the grab of FIG. 1 in closed position.
Figure 2B:
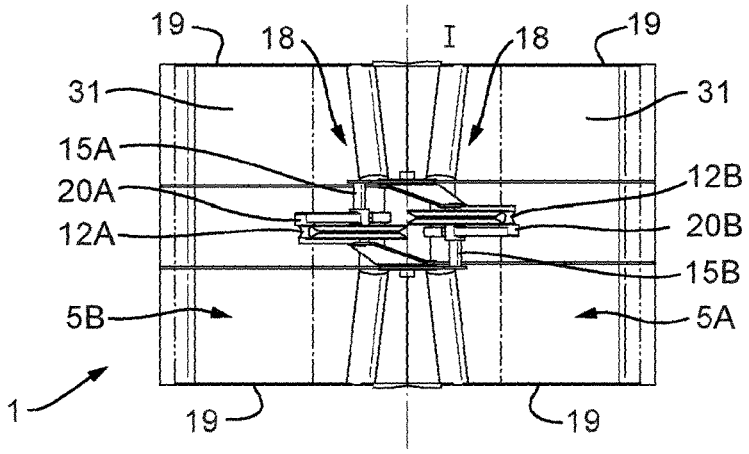
FIG. 2B shows a schematic top view of the grab of FIG. 1 in closed position.
Figure 3A:
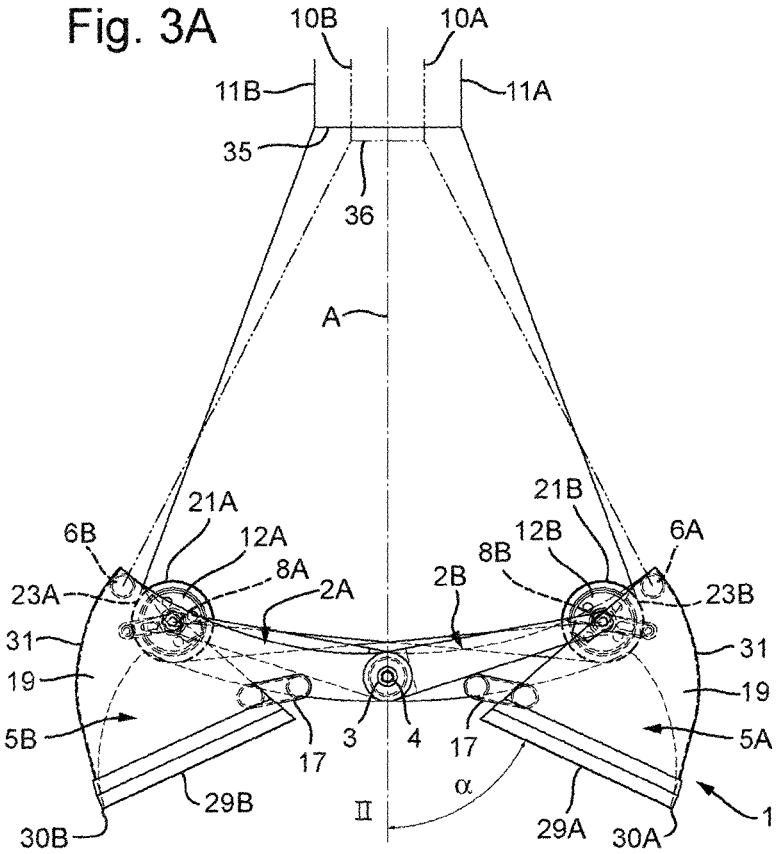
FIG. 3A shows a schematic front view of the grab of FIG. 1 in fully opened position.
Figure 3B:
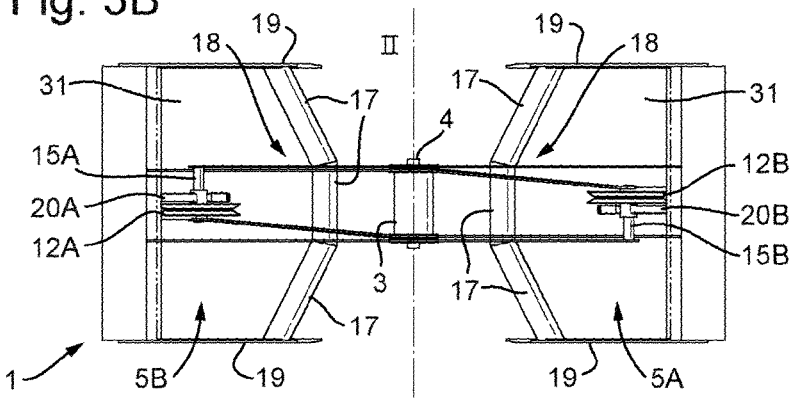
FIG. 3B shows a schematic top view of the grab of FIG. 1 in fully opened position.

Referring to FIGS. 1-3, a four cable operated scissors grab 1 is shown. The grab 1 comprises a pair of scissor levers 2*a*, 2*b*. The scissor levers 2*a*, 2*b* are connected via a conventional pivot joint 3 and are arranged to pivot about a pivoting axis 4 central to the pivot joint.

The scissor levers 2*a*, 2*b* each include a grab shell 5*a*, 5*b*, and a hoist cable connection 6*a*, 6*b* situated on a first side 7*a*, 7*b* of the first and second levers 2*a*, 2*b* respectively. The scissor levers 2*a*, 2*b* of the grab 1 further include a closing cable connection 8*a*, 8*b* on a second side 9*a*, 9*b* of the first and second levers 2*a*, 2*b* respectively. As may be seen best in FIGS. 2A and 3A, in use a dedicated hoisting cable 10*a*, 10*b* is fastened to the first side 7*a*, 7*b* of the levers 2*a*, 2*b* respectively, and a dedicated closing cable 11*a*, 11*b* is fastened to the second side 9*a*, 9*b* of the first and second levers 2*a*, 2*b* respectively. The scissor levers 2*a*, 2*b* each include a sheave on the second side 9*a*, 9*b* of the levers 2*a*, 2*b* respectively, which sheaves are arranged as first and final closing sheave 12*a*, 12*b* for the closing cable 11*a*, lib.

In use each of the two closing cables 11*a*, 11*b* extend in the single pass from a respective closing cable connection 8*a*, 8*b* on the second side 9*a*, 9*b* of one lever 2*a*, 2*b* via the closing sheave 12*a*, 12*b* on the second side 9*a*, 9*b* of the other lever 2*a*, 2*b*. The closing cables 11*a*, 11*b* depart the grab 1, and continue upward to a crane 13 carrying the grab 1.

Each final closing sheave 12*a*, 12*b* is situated at an end 14*a*, 14*b* of the second side 9*a*, 9*b* of the respective lever 2*a*, 2*b* that faces away from the pivot joint 3. The scissor levers 2*a*, 2*b* each include only one closing sheave, which is embodied as a final closing sheave 12*a*, 12*b*. No further or auxiliary closing sheaves are present. The grab 1 includes rotational connections at only the two final closing sheaves 12*a*, 12*b* and at the pivot joint 3.

For each scissor lever 2*a*, 2*b* the first sides 7*a*, 7*b* and second sides 9*a*, 9*b* of the levers 2*a*, 2*b* extend in the same plane. The levers 2*a*, 2*b* each extend continuously at the pivot joint. The levers 2*a*, 2*b* each include two steel lever plates 16 that continuously extend with interspace from each other from the grab shell 5*a*, 5*b* respectively to the final closing sheave 12*a*, 12*b*.

The final closing sheaves 12*a*, 12*b* are provided on the second sides 9*a*, 9*b* of the levers 2*a*, 2*b* respectively via rotational connections 15*a*, 15*b*. The rotational connections are formed by pivot axles 28 on which the final closing sheaves 12*a*, 12*b* are bearing mounted.

The scissor levers 2*a*, 2*b* each include stiffening profiles 17 on the first sides 7*a*, 7*b* that extend parallel to the pivoting axis 4. The profiles 17 are embodied by sections that extend between the lever plates 16 and between the lever plates 16 and the sides 19 of the grab shells 5*a*, 5*b* to form a cross stiffener that continues from one side of the shell to another. The profiles extend with interspace along the bottom 31 of the grab shells 5*a*, 5*b*.

The scissor levers 2*a*, 2*b* are substantially identical and are connected via the pivot joint 3 in mirrored arrangement, so that an symmetrical construction is achieved.

The closing cable connection 8*a*, 8*b* respectively is situated at the end 14*a*, 14*b* of the second side 9*a*, 9*b* of the respective first and second levers 2*a*, 2*b*. As shall be discussed more in detail with respect to FIG. 6, the final closing sheaves 12*a*, 12*b* are each provided with a cable guide 20*a*, 20*b* that covers part of the circumference 21*a*, 21*b* of the final closing sheaves 12*a*, 12*b* to hold the closing cable 10*a*, 10*b* on the final closing sheave 12*a*, 12*b*. This is particularly useful when during operating, the closing cable becomes slack. The cable guide 20*a*, 20*b* is rotatably disposed relative to the final closing sheave 12*a*, 12*b*. The cable guide 20*a*, 20*b* includes the closing cable connection 8*a*, 8*b* to allow movement of the cable guide 20*a*, 20*b* relative to the final closing sheave 12*a*, 12*b* during operation. The closing cable connection 8*a*, 8*b* is rotatably disposed relative to the lever 2*a*, 2*b*. In this example the closing cable connection 8*a*, 8*b* and the cable guide 20*a*, 20*b* are integrated and form a closing cable connector with integral cable guide 32. This shall be discussed more in detail further on with respect to FIGS. 6 and 7.

The scissor levers 2*a*, 2*b* are arranged to pivot about the pivot axis 4 between a closed position I of the grab 1 in which side edges 29*a*, 29*b* and bottom edges 30*a*, 30*b* of the shells 5*a*, 5*b* are adjacent each other and the shells cooperate to form a bucket that can hold material to be handled, and a fully opened position II of the grab 1. In the fully opened position II of the grab 1, the side edges 29*a*, 29*b* and bottom edges 30*a*, 30*b* of the shells are spaced apart and define a maximum opening there between through which material to be handled can pass. The fully opened position II is shown in FIGS. 3*a*, 3*b*, 4*d*, 4*e*. When the grab 1 moves from the closed position I to the fully opened position II, a plane through the pivot axis and the side edges 29*a*, 29*b* and bottom edges 30*a*, 30*b* has an angular displacement a about the pivot axis 4 that is 65 degrees. The angle α as depicted is also known to the skilled person as the maximum opening angle of the shell of the grab.

In FIG. 4 it is shown that the grab is suspended from a crane 13, from which structure only its sheaves 37 are shown. The crane 13 includes a set of two hoisting cables 10*a*, 10*b* that are connected to the hoisting cable connections 6*a*, 6*b*. The grab 1 also includes a set of two closing cables 11*a*, 11*b* that are connected to the closing cable connections 8*a*, 8*b*.

The closing cables 11*a*, 11*b* are interconnected via a connecting piece 35, embodied as a chain. The connecting piece 35 is affixed to the closing cables 11*a*, 11*b* near the grab 1 to move along with the closing cables on the opening and closing stroke S of the grab 1 when it moves between the closed position I and the fully opened position II.

Figure 4A:
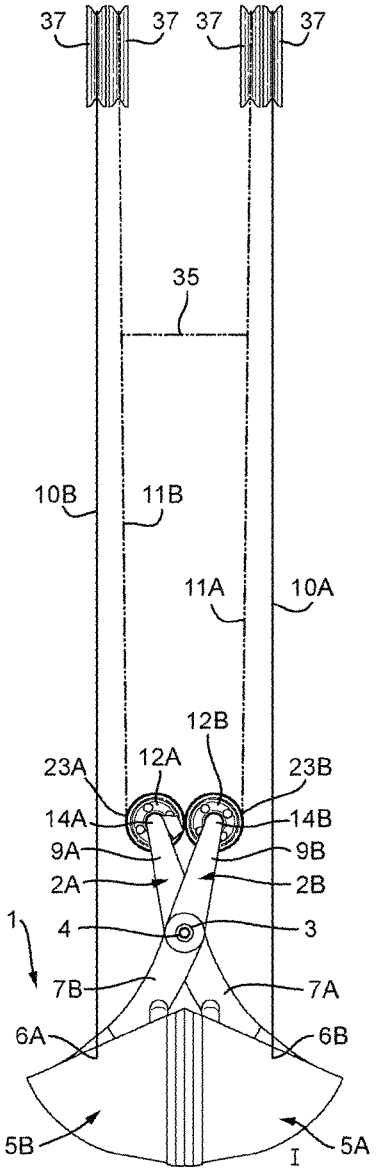
FIG. 4A shows a schematic front view of the grab of FIG. 1 in closed position attached to a crane.
Figure 4B:
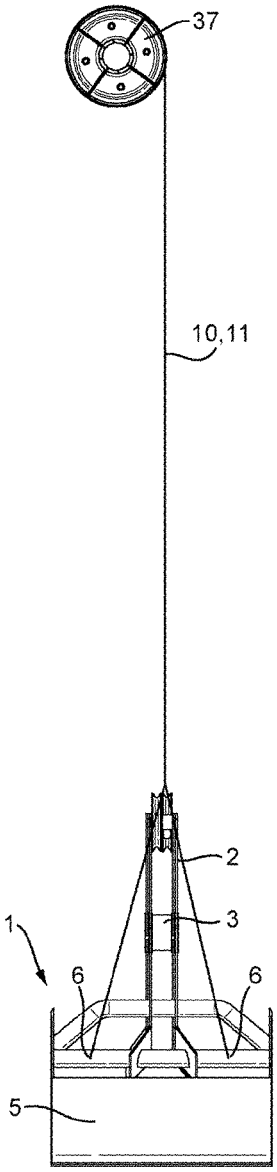
FIG. 4B shows a schematic side view of the grab of FIG. 4A.
Figure 4C:
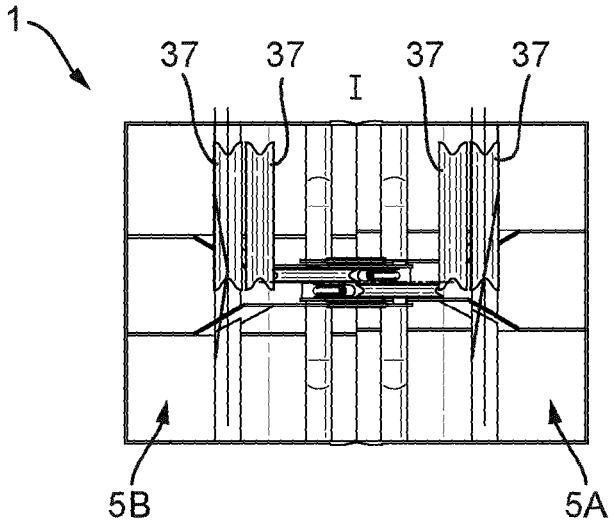
FIG. 4C shows a schematic top view of the grab of FIG. 4A.
Figure 4E:
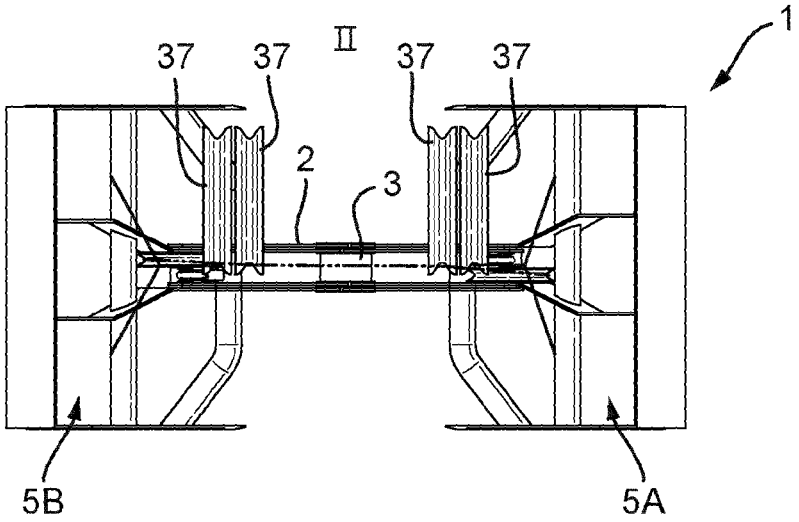
FIG. 4E shows a schematic top view of the grab of FIG. 4D.
Figure 4D:
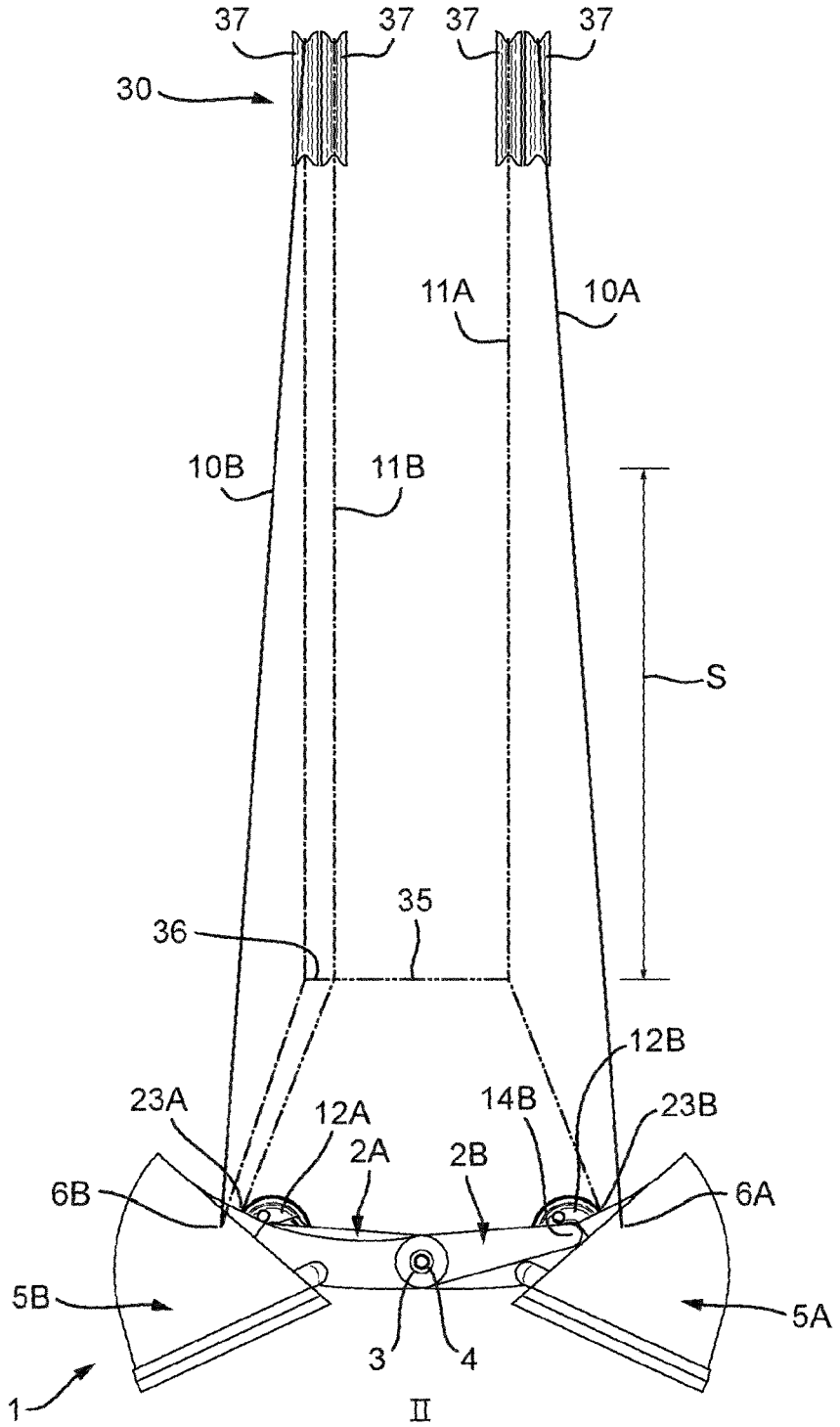
FIG. 4D shows a schematic front view of the grab of FIG. 4A in fully opened position.

Also the hoisting cables 10*a*, 10*b* may be interconnected via a connecting piece 36. The connecting piece 36 may be separate, and can be affixed to the hoisting cables 10*a*, 10*b* near the grab 1 to move along with the opening cables on the opening and closing stroke S of the grab 1 when it moves between the closed position I and the fully opened position II. A portion of such a connecting piece 36 for the hoisting cables 10*a*, 10*b* is shown in FIG. 4*d* in dotted lines. Here it can be seen that a connecting piece may also assist to provide a correct fleet angle of the cable with respect of the sheaves 37 of the crane 13 carrying the grab 1.

When suspended from the crane 13 as shown in FIG. 4, the operation of the grab is a follows. The grab 1 can move from the closed position I to the fully opened position II under the influence of gravity when the closing cables 11*a*, 11*b* are reeled off. The crane 13 then 1 reels the closing cables 11*a*, 11*b* off via its sheaves to make an opening stroke S. The crane 13 winches the closing cables 11*a*, 11*b* back up on a closing stroke S to move the grab 1 from the fully opened position II to the closed position I. The crane 13 can lift the grab 1 without moving it between the closed and opened positions I, II by winching both the hoisting cables 10*a*, 10*b* and the closing cables 11*a*, 11*b* up via its sheaves 37, and can lower the grab 1 again by reeling the hoisting cables 10*a*, 10*b* and closing cables 11*a*, 11*b* off.

Figure 5A:
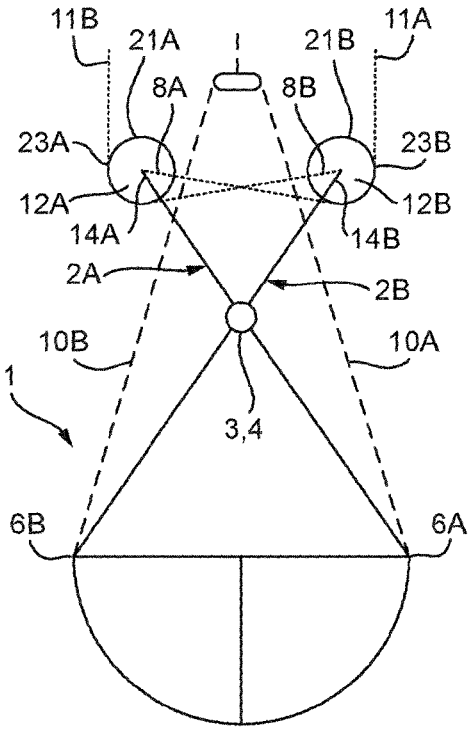
FIG. 5A-B show two schematic front views of the grab according to the invention with the closing cables on the outside and inside of the final closing sheaves respectively.
Figure 5B:
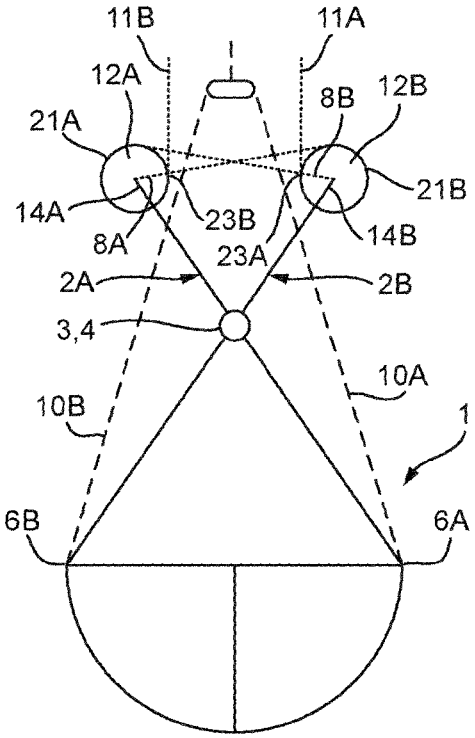

FIGS. 5A-B show two schematic front views of the grab according to the invention, to illustrate reeving of the closing cables 11*a*, 11*b*. FIG. 5*a* and FIG. 5*b* show alternative reeving patterns. In both patterns, each closing cable 11*a*, 11*b* extends only in a single reeve between its point of connection 8*a*, 8*b* on the lever 2*a*, 2*b* and the final closing sheave 12*a*, 12*b*, then extends around a part of the circumference of the final closing sheave 12*a*, 12*b* to a point of departure 23*a*, 23*b* on the circumference 21*a*, 21*b* of the final closing sheave 23*a*, 23*b*, to depart from the grab 1 and continue upward to the crane 13. In use, the closing cable 11*a*, 11*b* extends around about 90 degrees of the circumference of the final closing sheave 12*a*, 12*b*. No further or auxiliary closing sheaves 12*a*, 12*b* need be provided. As is illustrated in FIG. 5*a* and FIG. 5*b*, the point of departure 23*a*, 23*b* may be located on the outside or inside of the grab 1 respectively. When located on the inside, the closing cable 11*a*, 11*b* extends around about 270 degrees of the circumference of the final closing sheave 12*a*, 12*b*.

Due to the closing sheaves on the grab 1 being arranged as final closing sheaves 12*a*, 12*b*, the closing cables 11*a*, 11*b* in the closed position I of the grab 1 typically extend upward to the crane 13 spaced apart and mirrored from an upright center plane A of the grab 1 passing through or including the rotation axis of the grab. After leaving the final closing sheave 12*a*, 12*b*, the closing 11*a*, 11*b* cables extend to the crane 13 without passing over the center of the grab, and in particular without being guided back through the upright center plane A to the lever arm that carries its cable connection.

Figure 6:
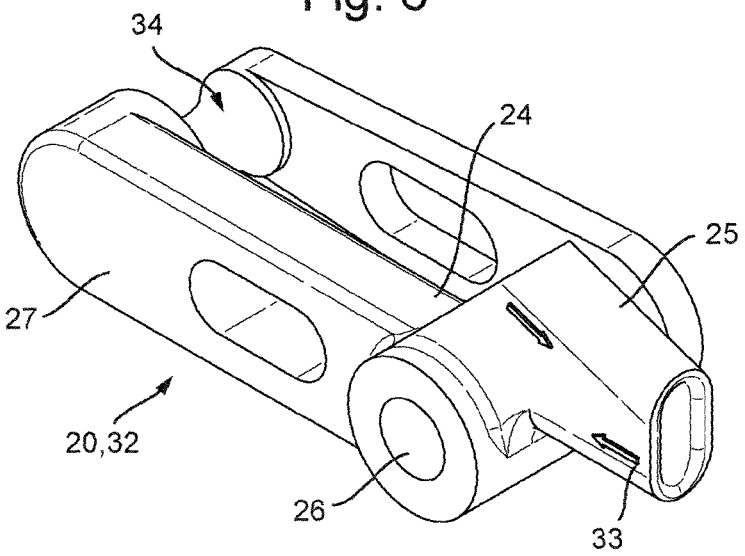
FIG. 6 shows schematic perspective view of a first embodiment of a closing cable connector with integral cable guide.

In FIG. 6, the closing cable connector with integral cable guide 32 is shown more in detail. It comprises a carrier 24 that is rotatably connected to the second side 9*a*, 9*b* of the first and second lever 2*a*, 2*b* respectively. The carrier 24 comprises a first portion 25 with a cable connecting part 33 to which the closing cable 10*a*, 10*b* connects, and that extends from a rotational joint 26 in a first direction. The carrier 24 further includes a second portion 25 that is provided with a cable guide part 34 and that extends from the rotational joint in a second, opposite direction. The rotational joint 26 of the carrier 24 is carried on the pivot axle 28 of the final closing sheave 12*a*, 12*b*, and is independently rotatable.

The cable guide part 34 covers a part of the circumference 21*a*, 21*b* of the final closing sheave 12*a*, 12*b*. During operation, it holds the closing cable 10*a*, 10*b* on the circumference 21*a*, 21*b* of the closing sheave 12*a*, 12*b*. In the embodiment of FIG. 6, the cable connector with integral guide 32 is embodied to only guide at the point on the circumference 21*a*, 21*b*. The closing cable connecting part 33 on the first portion 25 of the carrier 24 is embodied as a so called rope wedge socket.

Figure 7:
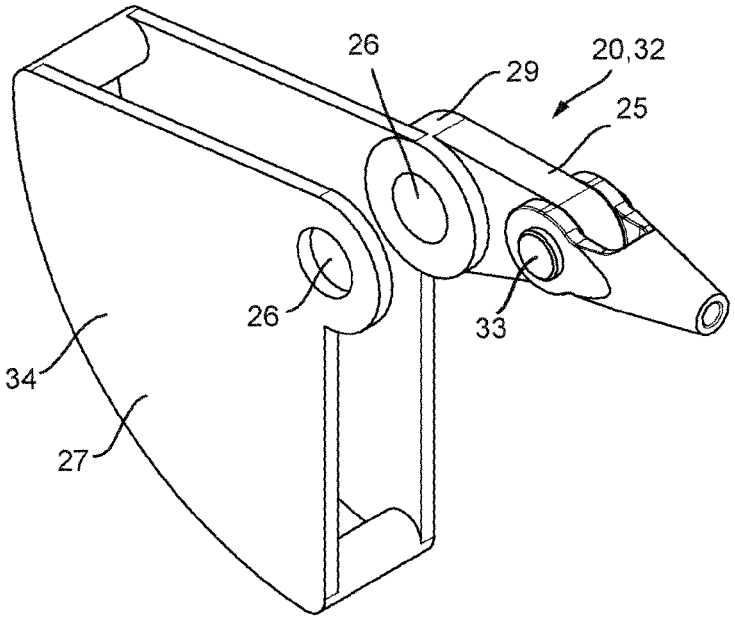
FIG. 7 shows a second embodiment of a closing cable connector with integral cable guide.
Figure 8:
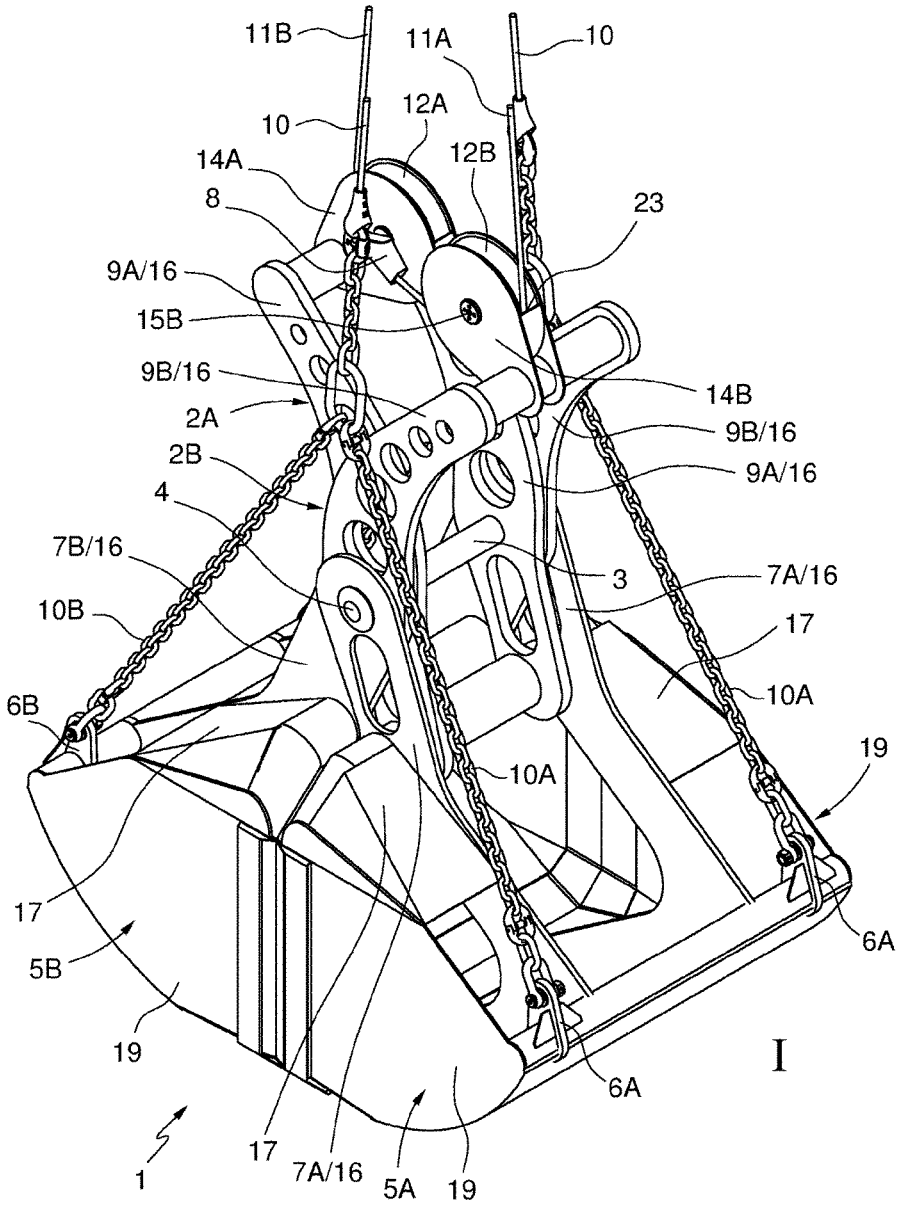
FIG. 8 shows a schematic perspective view of a further embodiment of a grab in accordance with the invention in a closed position.
Figure 9A:
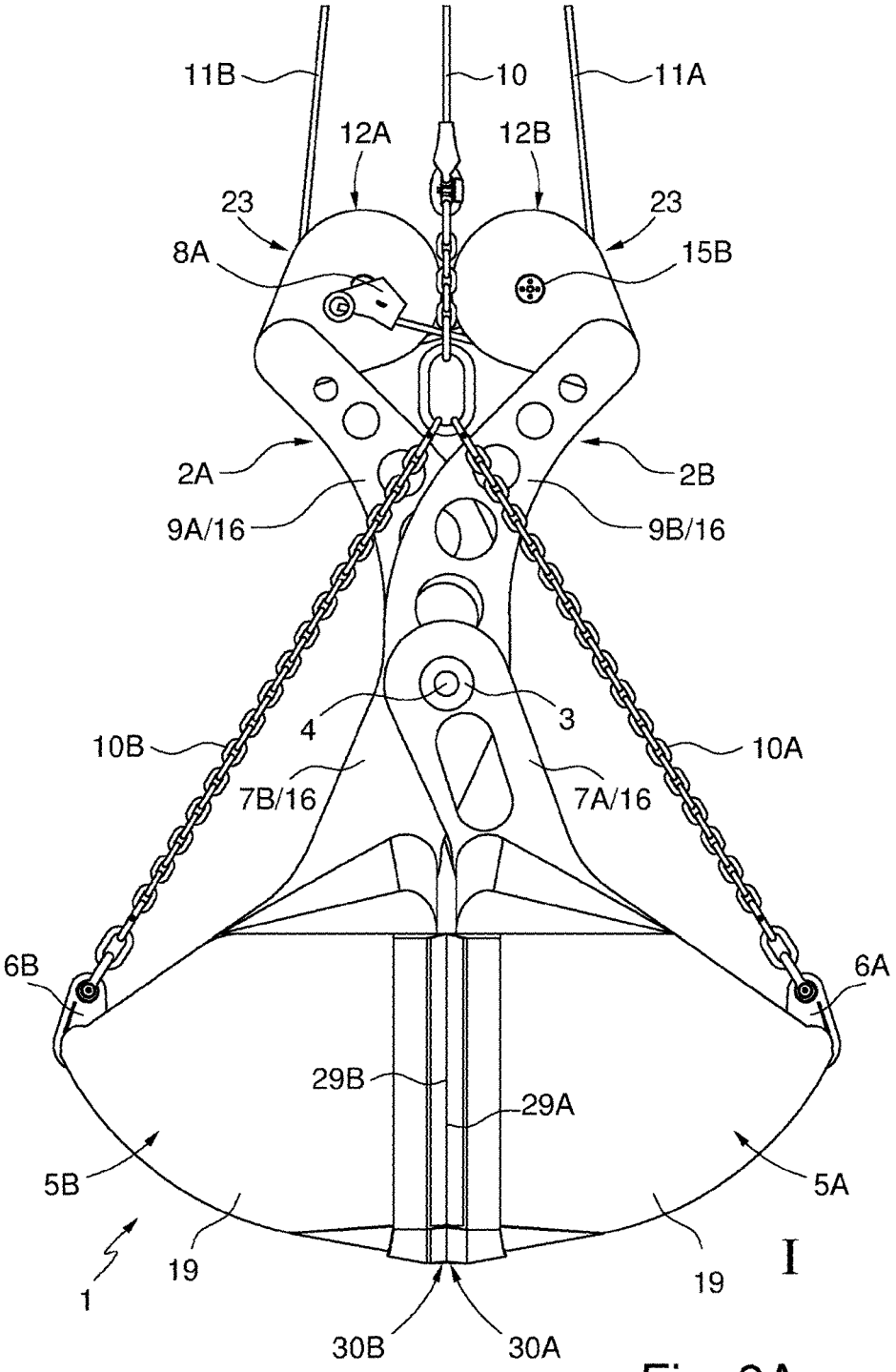
FIG. 9A shows a schematic front view of the grab of FIG. 8.
Figure 9B:
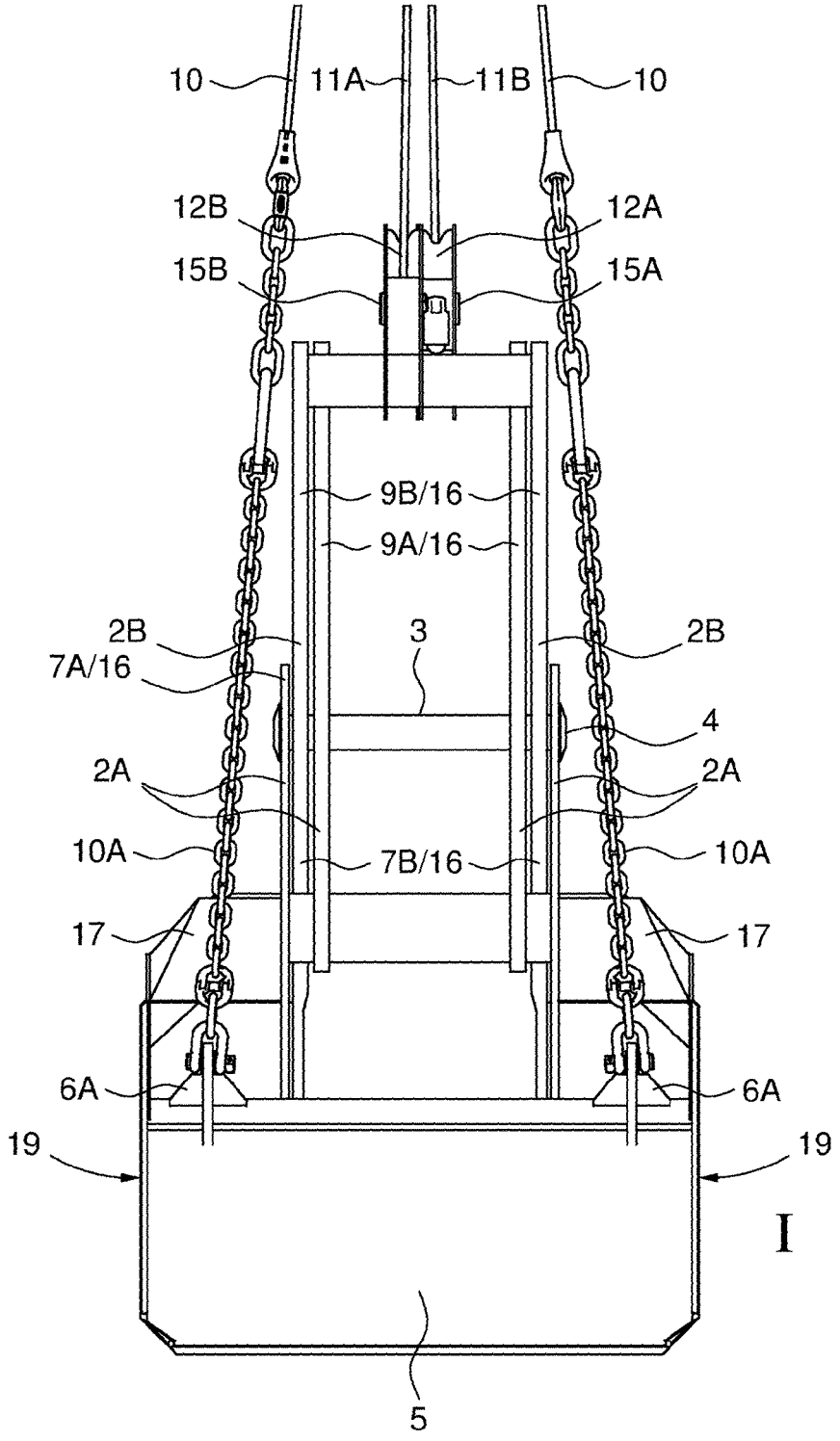
FIG. 9B shows a schematic side view of the grab of FIG. 8.
Figure 10:
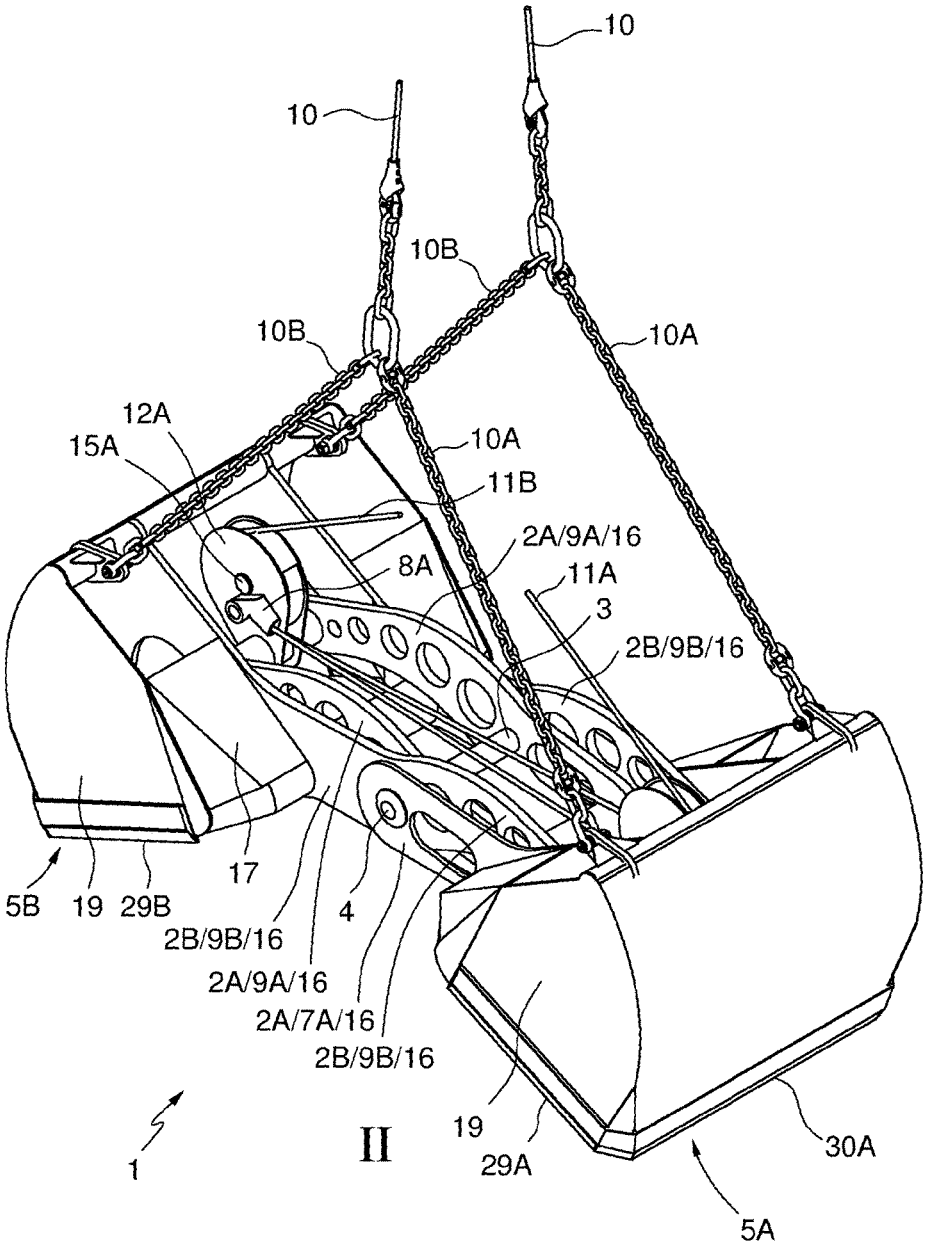
FIG. 10 shows a schematic perspective view of the grab of FIG. 8 in fully opened position.
Figure 11A:
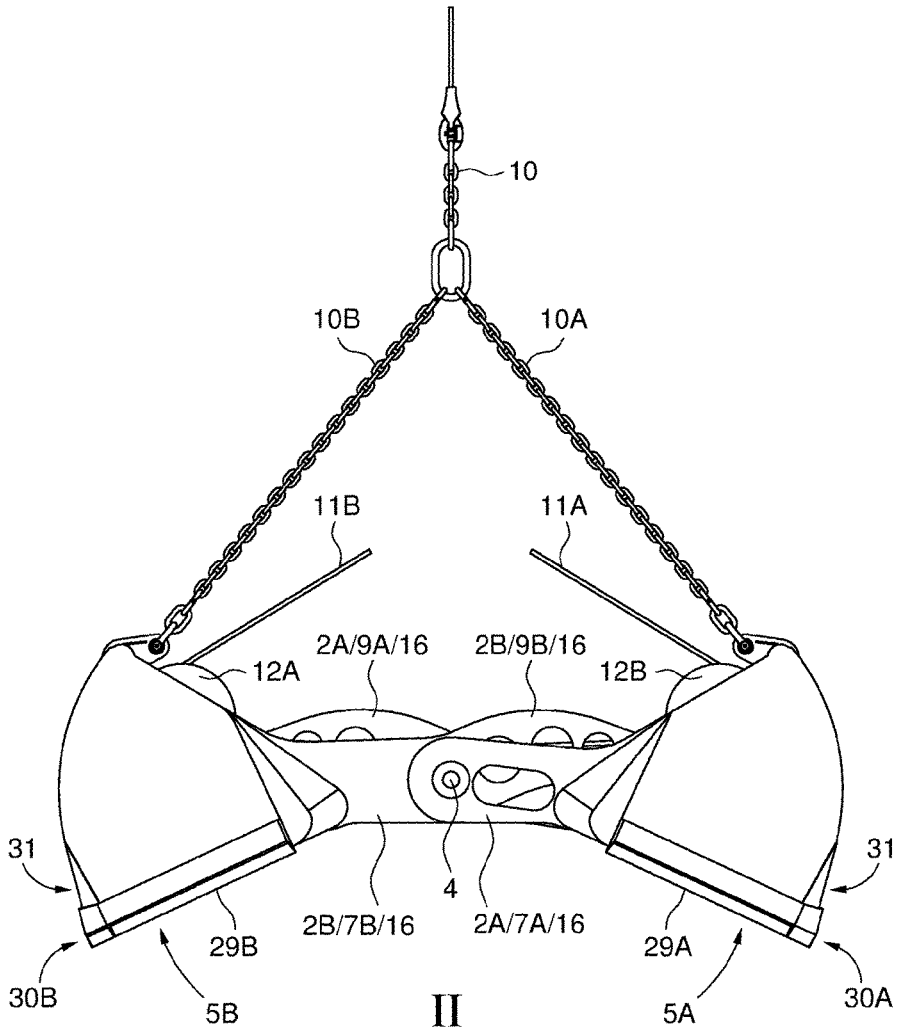
FIG. 11A shows a schematic front view of the grab of FIG. 10.
Figure 11B:
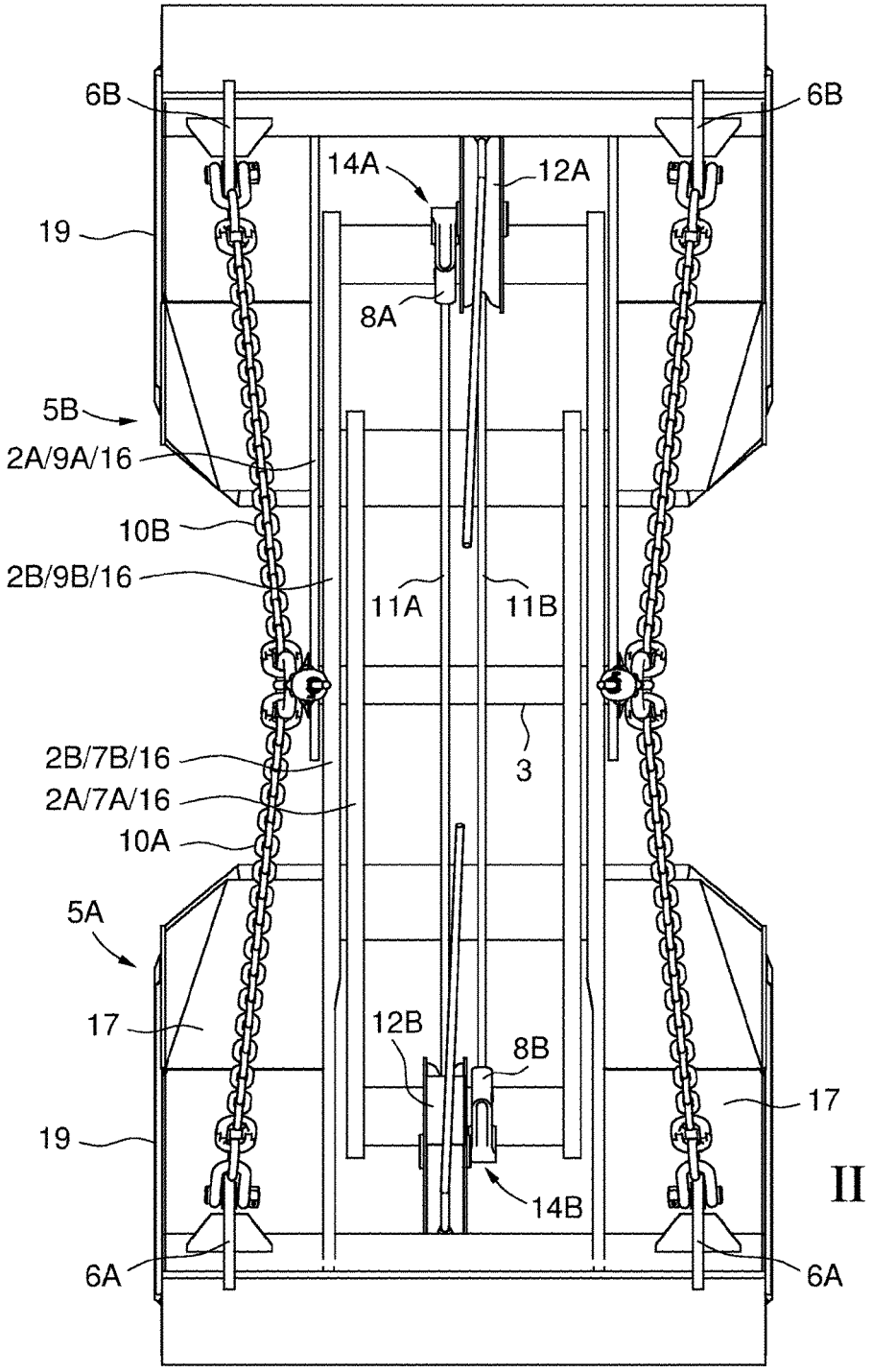
FIG. 11B shows a schematic top view of the grab of FIG. 10.

In a second embodiment which is shown in FIG. 7, the cable guide part 34 is arranged to guide the closing cable about an arc section of the circumference 21*a*, 21*b* of the closing sheave 21*a*, 21*b*, e.g. about 90 degrees. In this embodiment, the cable connecting part 33 includes a cable pear.

Figure 12:
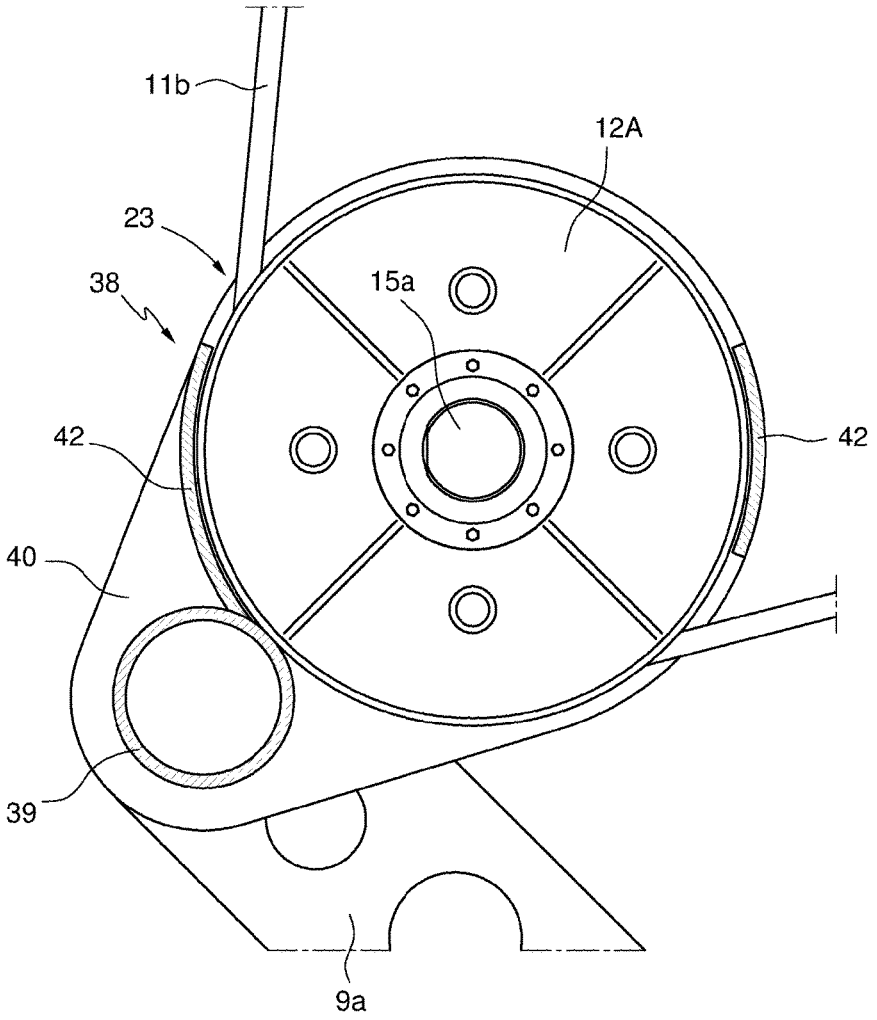
FIG. 12 shows a schematic cross section of a gaff section of the grab of FIG. 8.

Referring to FIGS. 8-12, a further embodiment of a grab 1 in accordance with the invention is shown. In this further embodiment, the second sides 9*a*, 9*b* of the scissor levers 2*a*, 2*b* are curved outwardly, and the final closing sheaves 12*a*, 12*b* are located in gaff sections 38*a*, 38*b* that form the ends 14*a*, 14*b* of the second sides 9*a*,9*b* of the scissor levers 2*a*, 2*b*. The gaff sections 38*a*, 38*b* include parallel planar gaff plates 40 that are non-rotatably affixed to a transverse stiffener, here embodied as a tube 39. The two parallel planar plates 40 of each gaff house a final closing sheave 12 between them. Each final closing sheave 12 is bearing mounted on an axle so as to form a rotational connection 15. The closing cable connections 8 are here formed by a conventional rope wedge socket that is rotatably carried a the gaff plate 40. Stationary cable guides 42 formed as a curved skirt extend along a part of the final closing sheave, as can be seen in FIG. 12. The gaff guides 42 are mounted with the base of the skirt on one of the gaff plates 40, and along their height extend transversely toward the facing gaff plate 40.

In this further embodiment, the grab 1 has the same basic structure and functionality as the grab 1 of the first embodiment. However, the scissor levers 2*a*, 2*b* are configured differently than in the first embodiment. In particular, the scissor levers are each built up of parallel planar plates that are interspaced by transverse stiff elements. One scissor lever 2*b* extends continuously at the pivot axis 4, while the other scissor 2*a* lever is interrupted at the pivot axis 4. An inner portion of the crossing lever 2*a*, i.e. the second side 9*a*, includes an extension 43 that extends beyond a transverse tube 44 to partially overlap with an outer portion of the crossing lever 2*a*, i.e. first side 7*a*, up to a transverse stiffener 45 that is arranged in parallel to the pivot tube. In this embodiment, the transverse stiffener is embodied as a tube. Also, the ends 14*a*, 14*b* of the scissor levers 2*a*, 2*b* comprise transverse stiffeners 39, here also embodied as tubes, that carry gaff sections 38. The gaff sections 38 are again arranged as parallel planar gaff plates 40. Such arrangement of the scissor levers as parallel planar plates interspaced by transverse stiffening elements allows for a lightweight, yet stiff construction, with e.g. a relatively light pivot joint 3. The invention therefore also relates to a four cable operated scissors grab, comprising a pair of scissor levers that are pivotably connected via a pivot joint, which scissor levers each include a grab shell and a hoist cable connection situated on a first side of the lever with respect to the pivot joint, and a closing cable connection situated on a second side of the lever that is opposite with respect to the pivot joint, so that in use a dedicated hoisting cable is fastened to each lever on the first side of the lever, and a dedicated closing cable is fastened to each lever at the second side of the lever, in which the scissor levers are arranged to pivot about the pivot axis between a closed position of the grab in which side and bottom edges of the shells are adjacent each other and the shells cooperate to form a bucket that can hold material to be handled, and a fully opened position of the grab in which the side and bottom edges are spaced apart and define a maximum opening there between through which material to be handled can pass, wherein the scissor levers are arranged as parallel planar plates interspaced by transverse stiff elements.

The invention is not limited to the exemplary embodiments represented here, but includes variations. For example, the configuration of the sheaves on the crane may vary. The invention may also be defined in terms of the cable arrangement on the grab, and may then not be limited to the presence of only a single, final closing sheave. Additional auxiliary closing sheaves may then be present. In such terms, the invention relates to a four cable operated scissors grab, comprising a pair of scissor levers that are connected via a pivot joint to pivot about a pivoting axis, which scissor levers each include a grab shell and a hoist cable connection situated on a first side of the lever with respect to the pivot joint, and a closing cable connection situated on a second side of the lever that is opposite with respect to the pivot joint, a dedicated hoisting cable being fastened to each lever on the first side of the lever, and a dedicated closing cable being fastened to each lever at the second side of the lever, wherein the scissor levers each include a sheave on the second side of the lever, characterized in that in use each of the two closing cables extends in a single pass from the closing cable connection on the second side of one lever via the closing sheave on the second side of the other lever to depart from the grab and to continue upward to a crane carrying the grab. Such variations shall be clear to the skilled person and are considered to fall within the scope of the invention as defined in the appended claims.

1 grab
2*a*, 2*b* lever
3 pivot joint
4 pivot axis
5*a*, 5*b* grab shell
6*a*, 6*b* hoist cable connection
7*a*, 7*b* first side of first respective second lever 2*a*, 2*b*
8*a*, 8*b* closing cable connection
9*a*, 9*b* second side of respective first and second lever
10*a*, 10*b* hoisting cable
11*a*, 11*b* closing cable
12*a*, 12*b* final closing sheave
13 crane
14*a*, 14*b* end of second part of respective first and second lever
15*a*, 15*b* rotational connection final closing sheave 12*a*, 12*b*
16 lever plate
17 stiffening profile
18 cross stiffener
19 side of shell
20*a*, 20*b* cable guide
21*a*, 21*b* circumference final closing sheave 12*a*, 12*b*
22 not used
23 point of departure
24 carrier
25 first portion carrier
26 rotational joint
27 second portion carrier
28 pivot axle
29*a*, 29*b* side edges
30*a*, 30*b* bottom edges
31 bottom of shell
32 cable connector with integral cable guide
33 cable connecting part
34 cable guide part
35 connecting piece closing cables
36 connecting piece hoisting cables
37 crane sheave
38 gaff section
39 tube
40 gaff plate
41 rope wedge socket
42 cable guide
43 extension
44 pivot tube
45 tube
I closed position grab
II fully opened position grab
$\alpha$ maximum opening angle grab shell
A center plane
S stroke

The invention claimed is:

1. A four cable operated scissors grab, comprising a pair of first and second scissor levers that are connected via a pivot joint to pivot about a pivoting axis, which first and second scissor levers each include a respective first and second grab shell and a respective first and second hoist cable connection situated on a first side of each of the first and second scissor levers with respect to the pivot joint, and a respective first and second closing cable connection situated on a second side of each of the first and second scissor levers that is opposite with respect to the pivot joint, so that in use a respective first and a second dedicated first and second hoisting cable is fastened to each of the first and second scissor lever on the first side of the respective scissor lever at respective first and second hoist cable connections, and a respective first and a second dedicated closing cable is fastened to each respective first and second scissor lever at the respective first and second closing cable connection at the second side of each of the first and second scissor lever, wherein each of the first and second scissor levers each include only a single respective first and second closing sheave on the second side of the first and second scissor lever and no other closing sheave, so that in use the first closing cables extends in a single pass from the first closing cable connection on the second side of the first scissor lever via the second closing sheave on the second side of the second scissor lever to depart from the scissors grab and continue upward to a crane carrying the scissors grab and the second closing cable extends in a single pass from the second closing cable connection on the second side of the second scissor lever via the first closing sheave on the second side of the first scissor lever to depart from the scissors grab and continue upward to the crane carrying the scissors grab.

2. The scissors grab of claim 1, in which each of the first and second closing sheave is situated at or near an end of the second side of the respective first and second scissor lever that faces away from the pivot joint.

3. The scissors grab of claim 1, in which apart from any rotational cable connections, the scissor grab includes rotational connections at only the first and second closing sheaves and at the pivot joint.

4. The scissors grab of claim 1, in which for each of the first and second scissor lever, the first and second sides of the first and second scissor lever extend continuously at the pivot joint.

5. The scissors grab of claim 1, in which the first and second scissor levers each include two lever plates that extend in interspaced relation.

6. The scissors grab of claim 1, in which the first and second scissor levers each include stiffening profiles on the first sides extending parallel to the pivoting axis.

7. The scissors grab of claim 6, wherein stiffening profiles are arranged to form a cross stiffener that continues from one side of the first and second grab shell to another side of the first and second grab shell.

8. The scissors grab of claim 1, in which each of the first and second scissor levers of the pair are substantially identical and are connected via the pivot joint in a mirrored arrangement.

9. The scissors grab of claim 1, in which each of the first and second closing cable connection is situated at or near an end of the second side of the first and second scissor lever that faces away from the pivot joint.

10. The scissors grab of claim 1, in which each of the first and second closing sheaves are each provided with a respective first and second cable guide that covers part of the circumference of the first and second closing sheave to hold the respective second and first closing cable on the first and second closing sheave.

11. The scissors grab of claim 10, in which the first and second cable guide is movably disposed relative to the first and second closing sheave.

12. The scissors grab of claim 11, in which each of the first and second cable guide includes the first and second closing cable connection so as to allow movement relative to the first and second closing sheave.

13. The scissors grab of claim 10, in which the first and second closing cable connection and the first and second cable guide are integrated.

14. The scissors grab of claim 13, comprising a first carrier and a second carrier, rotatably connected to the second side of each of the respective first and second scissor lever, which each first carrier and second carrier includes a first portion to which the respective first or second closing cable connects that extends from a rotational joint in a first direction, and that further includes a second portion that is provided with a cable guide that extends from the rotational joint in a second, opposite direction, and that covers part of a circumference of the respective first and second closing sheaves to hold the respective second and first closing cable on the first and second closing sheave.

15. The scissors grab of claim 14, wherein the rotational joint of the first carrier and the second carrier is carried on a pivot axle of the respective first and second closing sheave.

16. A cable connection with integral cable guide for the scissors grab in accordance with claim 15, comprising a carrier rotatably connected to the scissors grab, including a first portion to which the closing cable connects that extends from a rotational joint in a first direction, and further including a second portion that is provided with a closing cable guide that extends from the rotational joint in a second, opposite direction, and which closing cable guide covers part of a circumference of the closing sheave of the scissors grab to hold the closing cable on the circumference of the closing sheave.

17. The scissors grab of claim 1, in which each of the first and second closing cable connection is rotatable relative to respective first and second scissor lever.

18. The scissors grab of claim 1, in which the first and second scissor levers are arranged to pivot about the pivot axis between a closed position of the scissors grab in which side and bottom edges of the first and second grab shells are adjacent each other and the first and second grab shells cooperate to form a bucket that can hold material to be handled, and a fully opened position of the scissors grab in which the side and bottom edges are spaced apart and define a maximum opening there between through which material to be handled can pass.

19. The scissors grab of claim 18, in which when the scissors grab moves from the closed position to the fully opened position, a plane through the pivot axis and the side and bottom edges of the first and second grab shells has an angular displacement about the pivot axis that is included in the range of 50-70 degrees.

20. The scissors grab of claim 1, including a set of first and second hoisting cables that are connected to the respective first and second hoist cable connections.

21. The scissors grab of claim 1, including a set of first and second closing cables that are connected to the respective first and second closing cable connections.

22. The scissors grab of claim 21, in which the first and second closing cables are interconnected via a connecting piece.

* * * * *